US011114014B2

(12) United States Patent
Lee et al.

(10) Patent No.: US 11,114,014 B2
(45) Date of Patent: Sep. 7, 2021

(54) DATA DRIVING DEVICE AND DISPLAY DEVICE INCLUDING THE SAME

(71) Applicant: SAMSUNG DISPLAY CO., LTD., Yongin-si (KR)

(72) Inventors: Dong-Eup Lee, Asan-si (KR); Ji-Hyun Ka, Seongnam-si (KR); Ki Myeong Eom, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/807,505

(22) Filed: Mar. 3, 2020

(65) Prior Publication Data

US 2020/0286418 A1 Sep. 10, 2020

(30) Foreign Application Priority Data

Mar. 5, 2019 (KR) ..... 10-2019-0025307

(51) Int. Cl.

| | |
|---|---|
| ***G09G 3/20*** | (2006.01) |
| ***G09G 3/3266*** | (2016.01) |
| ***G09G 3/3275*** | (2016.01) |
| ***G09G 3/36*** | (2006.01) |

(52) U.S. Cl.

CPC ..... *G09G 3/2003* (2013.01); *G09G 3/3266* (2013.01); *G09G 3/3275* (2013.01); *G09G 3/3677* (2013.01); *G09G 3/3688* (2013.01); *G09G 2310/0286* (2013.01); *G09G 2320/0673* (2013.01)

(58) Field of Classification Search

CPC .. G09G 3/2003; G09G 3/3266; G09G 3/3275; G09G 3/3677; G09G 3/3688

USPC ..... 345/77, 88, 204, 694

See application file for complete search history.

(56) References Cited

U.S. PATENT DOCUMENTS

| | | | | |
|---|---|---|---|---|
| 8,619,007 | B2 * | 12/2013 | Park | G09G 3/3266 345/76 |
| 10,242,634 | B2 * | 3/2019 | Sang | G09G 3/3275 |
| 2006/0119557 | A1 * | 6/2006 | Sano | G09G 3/3614 345/88 |

(Continued)

FOREIGN PATENT DOCUMENTS

| | | |
|---|---|---|
| KR | 10-1289652 | 7/2013 |
| KR | 10-1451589 | 10/2014 |

(Continued)

*Primary Examiner* — Prabodh M Dharia

(74) *Attorney, Agent, or Firm* — F. Chau & Associates, LLC

(57) ABSTRACT

A display device includes a display unit including first color subpixels, second color subpixels, and third color subpixels, a scan driver for applying scan signals to scan lines connected to the first color subpixels, the second color subpixels, and the third color subpixels, a switch circuit for selecting first data lines connected to the first color subpixels and the second color subpixels for a first section, and selecting second data lines connected to the third color subpixels for a second section after the first section, and a data driver for applying data signals corresponding to the third color subpixels to the switch circuit for a third section between the first section and the second section, and applying data signals corresponding to the first color subpixels and the second color subpixels to the switch circuit for a fourth section after the second section.

20 Claims, 5 Drawing Sheets

(56) References Cited

U.S. PATENT DOCUMENTS

| | | | | |
|---|---|---|---|---|
| 2014/0111406 | A1* | 4/2014 | Wang | G09G 3/3233 345/77 |
| 2014/0240379 | A1* | 8/2014 | Jeong | G09G 3/3266 345/691 |
| 2018/0151137 | A1* | 5/2018 | Lee | G09G 3/3607 |

FOREIGN PATENT DOCUMENTS

| | | |
|---|---|---|
| KR | 10-2014-0133271 | 11/2014 |
| KR | 10-2018-0045923 | 5/2018 |
| KR | 10-1910114 | 10/2018 |

* cited by examiner

DATA DRIVING DEVICE AND DISPLAY DEVICE INCLUDING THE SAME

CROSS-REFERENCE TO RELATED APPLICATION

This application claims priority under 35 U.S.C. § 119 to Korean Patent Application No. 10-2019-0025307, filed in the Korean Intellectual Property Office on Mar. 5, 2019, the disclosure of which is incorporated by reference herein in its entirety.

TECHNICAL FIELD

Exemplary embodiments of the inventive concept relate to a data driving device and a display device including the same.

DISCUSSION OF RELATED ART

In general, a display device includes a display panel for displaying images, and a driving circuit connected to the display panel and supplying signals for displaying images to the display panel. A plurality of pixels connected to signal lines such as a plurality of scan lines and a plurality of data lines are provided on the display panel. The driving circuit includes a scan driver for supplying a scan signal to the scan lines and a data driver for supplying a data signal to the data lines.

During one horizontal period, an output end of the data driver sequentially outputs different data signals corresponding to the data lines, and a demultiplexer provides the data signals sequentially output by the output end of the data driver to the data lines, respectively.

In the case of a high-resolution and high-frequency display device, the number of data lines is large and one horizontal period is short. Therefore, the data driver of the high-resolution and high-frequency display device outputs a plurality of data signals to respective output ends of the data driver for one horizontal period.

SUMMARY

According to an exemplary embodiment of the inventive concept, a display device may include a display unit including a plurality of first color subpixels, a plurality of second color subpixels, and a plurality of third color subpixels, a scan driver for applying scan signals to a plurality of scan lines connected to the plurality of first color subpixels, the plurality of second color subpixels, and the plurality of third color subpixels, a switch circuit for selecting a plurality of first data lines connected to the plurality of first color subpixels and the plurality of second color subpixels for a first section in each horizontal period, and selecting a plurality of second data lines connected to the plurality of third color subpixels for a second section after the first section in each horizontal period, and a data driver for applying data signals corresponding to the plurality of third color subpixels to the switch circuit for a third section between the first section and the second section in each horizontal period, and applying data signals corresponding to the plurality of first color subpixels and the plurality of second color subpixels to the switch circuit for a fourth section after the second section in each horizontal period.

The data driver may include a shift register for shifting a source start pulse and sequentially generating a sampling pulse corresponding to source sampling clock signals, sampling latches for sequentially storing first data corresponding to the plurality of first color subpixels and the plurality of second color subpixels and second data corresponding to the plurality of third color subpixels, in response to the sampling pulse, holding latches for substantially simultaneously receiving the first data stored in the sampling latches and storing the same corresponding to a first source output enable signal, and substantially simultaneously receiving the second data stored in the sampling latches and storing the same corresponding to a second source output enable signal, and a digital-analog converter for generating data signals corresponding to the plurality of first color subpixels and the plurality of second color subpixels by using the first data stored in the holding latches, and generating data signals corresponding to the plurality of third color subpixels by using the second data.

The sampling latches may include first sampling latches for storing the first data corresponding to the plurality of first color subpixels and the plurality of second color subpixels, and second sampling latches for storing the second data corresponding to the plurality of third color subpixels. The shift register may apply the sampling pulse to the first sampling latches and may apply the sampling pulse to the second sampling latches.

The holding latches may include first holding latches connected to the first sampling latches, and second holding latches connected to the second sampling latches. The first source output enable signal may be applied to the first holding latches when the sampling pulse is applied to the first sampling latches, and the second source output enable signal may be applied to the second holding latches when the sampling pulse is applied to the second sampling latches.

The data driver may include a multiplexer for selectively outputting one of a data signal corresponding to the plurality of first color subpixels and the plurality of second color subpixels and a data signal corresponding to the plurality of third color subpixels in response to a control signal, and an output buffer for transmitting the data signals output by the multiplexer to a data line.

The multiplexer may output the data signal corresponding to the plurality of third color subpixels for a third section between the first section and the second section in each horizontal period, and may output the data signal corresponding to the plurality of first color subpixels and the plurality of second color subpixels for a fourth section after the second section in each horizontal period in response to the control signal.

The source start pulse may be synchronized with each horizontal period and may be applied to the shift register.

The digital-analog converter may convert the first data and the second data into data signals with analog voltages by using at least one of a plurality of input gamma voltages.

The switch circuit may include first transistors connecting the data driver to the plurality of first data lines corresponding to a first selection signal, and second transistors connecting the data driver to the plurality of second data lines corresponding to a second selection signal.

The first transistors and the second transistors may be provided on a same substrate as the display panel.

The scan driver may sequentially apply a scan signal having an enable level to the scan lines, the scan signal may have the enable level for a fifth section after the first section in each horizontal period, and at least part of the fifth section and the second section may overlap each other.

The first section may be shorter than the second section.

The display unit may include the plurality of scan lines, the plurality of first data lines, and the plurality of second data lines, and the plurality of first data lines and the plurality of second data lines may extend in a first direction and may be alternately provided in a second direction traversing the first direction.

According to an exemplary embodiment of the inventive concept, a data driving device for outputting data signals to a switch circuit for selecting a plurality of first data lines connected to a plurality of first color subpixels and a plurality of second color subpixels for a first section in each horizontal period, and selecting a plurality of second data lines connected to a plurality of third color subpixels for a second section after the first section, may include a shift register for shifting a source start pulse and sequentially generating a sampling pulse corresponding to source sampling clock signals, sampling latches for sequentially storing first data corresponding to the plurality of first color subpixels and the plurality of second color subpixels and second data corresponding to the plurality of third color subpixels, in response to the sampling pulse, holding latches for substantially simultaneously receiving the first data stored in the sampling latches corresponding to a first source output enable signal and substantially simultaneously receiving the second data stored in the sampling latches corresponding to a second source output enable signal, and a digital-analog converter for generating a data signal corresponding to the plurality of first color subpixels and the plurality of second color subpixels by using the first data stored in the holding latches, and generating a data signal corresponding to the plurality of third color subpixels by using the second data.

The sampling latches may include first sampling latches for storing first data corresponding to the plurality of first color subpixels and the plurality of second color subpixels and second sampling latches for storing second data corresponding to the plurality of third color subpixels. The shift register applies the sampling pulse to the second sampling latches after applying the sampling pulse to the first sampling latches.

The holding latches may include first holding latches connected to the first sampling latches and second holding latches connected to the second sampling latches. The first source output enable signal may be applied to the first holding latches after the sampling pulse is applied to the first sampling latches and the second source output enable signal may be applied to the second holding latches after the sampling pulse is applied to the second sampling latches.

The data driving device may further include a multiplexer for selectively outputting one of a data signal corresponding to the plurality of first color subpixels and the plurality of second color subpixels and a data signal corresponding to the plurality of third color subpixels in response to a control signal, and an output buffer for transmitting the data signals output by the multiplexer to a data line.

The multiplexer may output the data signal corresponding to the plurality of third color subpixels for a third section between the first section and the second section in each horizontal period, and may output the data signal corresponding to the plurality of first color subpixels and the plurality of second color subpixels for a fourth section after the second section in each horizontal period in response to the control signal.

The source start pulse may be synchronized with each horizontal period and may be applied to the shift register.

The digital-analog converter may convert the first data and the second data into data signals with analog voltages by using at least one of a plurality of input gamma voltages.

According to an exemplary embodiment of the inventive concept, a display device may include a display unit including a plurality of first color subpixels, a plurality of second color subpixels, and a plurality of third color subpixels, a plurality of first data lines and a plurality of second data lines, a data driver configured to provide data signals to the plurality of first data lines and the plurality of second data lines, and a switch circuit including a plurality of first transistors connected to the plurality of first data lines and configured to transmit the data signals in response to a first selection signal, and a plurality of second transistors connected to the plurality of second data lines configured to transmit the data signals in response to a second selection signal. The plurality of first data lines and the plurality of second data lines may be alternately disposed. The plurality of first color subpixels and the plurality of second color subpixels may be alternately connected to the plurality of first data lines. The plurality of second data lines may be connected to the plurality of third color subpixels. The first selection signal and the second selection signal may be alternately activated in one horizontal period.

DETAILED DESCRIPTION OF THE EMBODIMENTS

Figure 1:
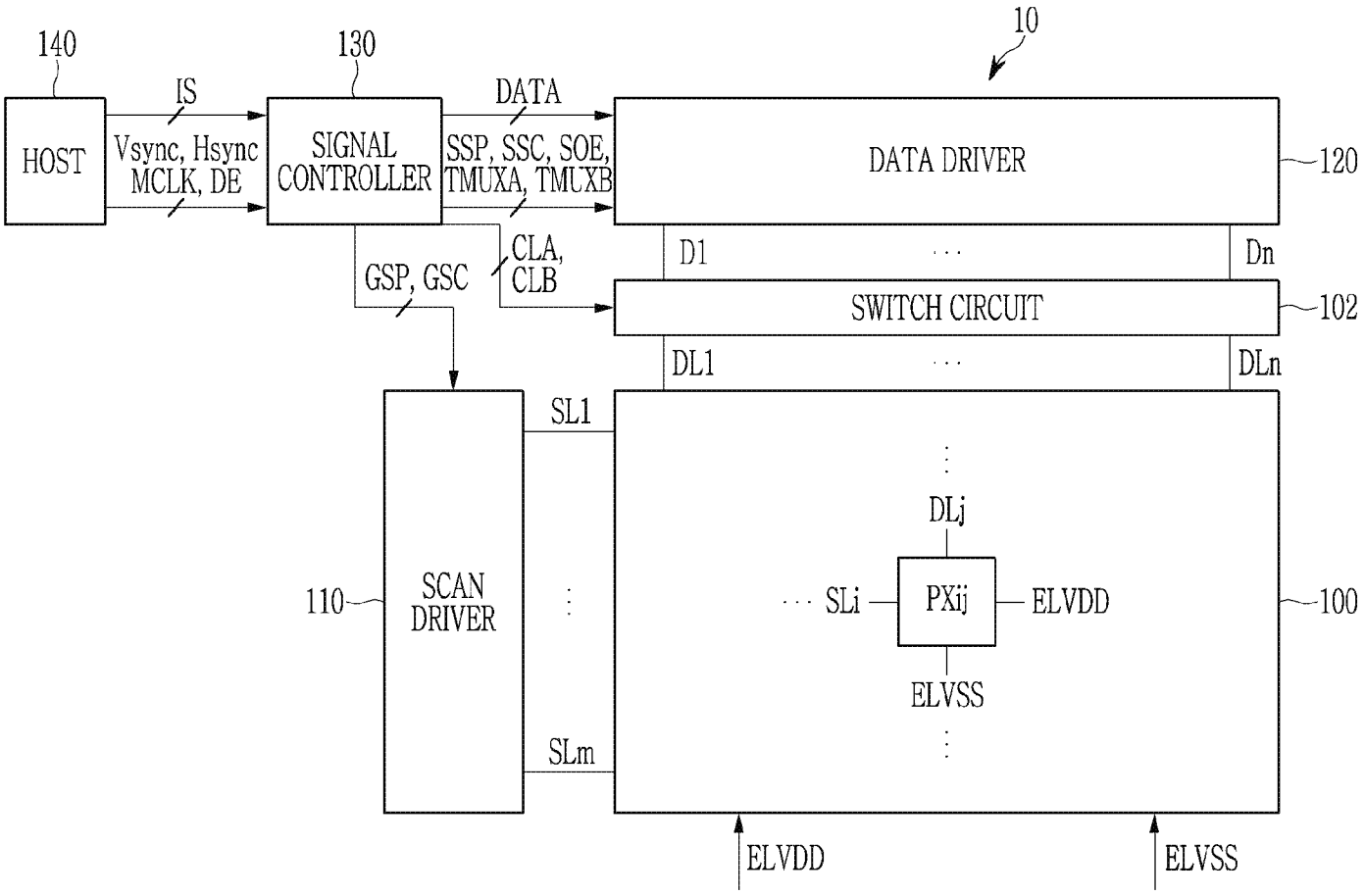
FIG. 1 shows a block diagram of a display device according to an exemplary embodiment of the inventive concept.

Exemplary embodiments of the inventive concept provide a display device applying data signals to data lines for one horizontal period.

Exemplary embodiments of the inventive concept will be described more fully hereinafter with reference to the accompanying drawings. Like reference numerals may refer to like elements throughout this application.

FIG. 1 shows a block diagram of a display device according to an exemplary embodiment of the inventive concept.

Referring to FIG. 1, a display device 10 includes a display panel 100, a scan driver 110, a data driver 120, a switch circuit 102, and a signal controller 130.

The display panel 100 includes pixels (PXij) connected to a plurality of scan lines (SL1 to SLm) and a plurality of data lines (DL1 to DLn). Here, n and m are positive integers. The display panel 100 may also be referred to as a display unit.

When the display device is an organic light emitting device, the pixels (PXij) each include a plurality of transistors including a driving transistor and an organic light emitting diode. The pixels (PXij) receive the data signal from a data line (DLj) when a scan signal is supplied through a scan line (SLi). The driving transistor included in the pixels (PXij) supplies a current corresponding to the data signal to the organic light emitting diode, and the organic light emitting diode accordingly emits light with a predetermined luminance. Here, i is an integer between 1 and m, and j is an integer between 1 and n.

When the display device is a liquid crystal display, the pixels (PXij) each include a switching transistor and a liquid crystal capacitor. The pixel (PXij) receives the data signal from the data line (DLj) when the scan signal is supplied through the scan line (SLi). The pixel (PXij) controls transmittance of liquid crystal corresponding to the data signal to control light with a predetermined luminance to be supplied to the outside. The pixel (PXij) may be supplied with driving voltages (ELVDD, ELVSSS).

Additionally, although FIG. 1 shows that the pixel (PXij) is connected to one data line (DLj) and one scan line (SLi), the inventive concept is not limited thereto. For example, various kinds of signal lines may be additionally connected to the pixel (PXij), corresponding to various circuit structures of the pixel (PXij). In other words, the pixels (PXij) may be implemented in known various ways in exemplary embodiments of the inventive concept.

The scan driver 110 is connected to the display panel 100 through the plurality of scan lines (SL1 to SLm). The scan driver 110 selects the plurality of scan lines (SL1 to SLm) based on gate control signals GSP and GSC transmitted by the signal controller 130.

When scan signals are supplied through the plurality of scan lines (SL1 to SLm), the pixels (PXij) are selected for respective scan lines. The data signals supplied to the data lines (DL1 to DLn) are supplied to the selected pixels (PXij) in response to the scan signals. The scan driver 110 may be mounted on the panel. In other words, the scan driver 110 may be mounted on the same substrate as the display panel 100 through a thin film process. The scan driver 110 may be mounted on a side of the display panel 100.

The data driver 120 generates data signals by using image data (DATA) input by the signal controller 130. The data driver 120 generates data signals by processing the image data (DATA) based on source control signals (SSP, SSC, and SOE) input by the signal controller 130.

A gamma voltage generator may be additionally installed inside/outside the data driver 120. The gamma voltage generator supplies a plurality of gamma voltages to the data driver 120. The data driver 120 generates data signals by selecting one of the plurality of gamma voltages corresponding to grays of the image data (DATA). The data driver 120 provides the generated data signals to the switch circuit 102 through the data channels (D1 to Dn).

The switch circuit 102 may receive selection signals (CLA and CLB) from the signal controller 130. The switch circuit 102 applies the data signals input by the data driver 120 to the plurality of data lines (DL1 to DLn) according to the selection signals (CLA and CLB).

The signal controller 130 receives image data signals (IS) and control signals output by a host 140. The control signals may include a horizontal synchronizing signal Hsync, a vertical synchronization signal Vsync, a main clock signal MCLK, and a data enable signal DE.

The signal controller 130 supplies a gate control signal to the scan driver 110 based on the image data signals (IS) and the control signals, and supplies the source control signals to the data driver 120.

The gate control signals include a gate start pulse (GSP) and at least one gate shift clock (GSC). The gate start pulse (GSP) controls a timing of the first scan signal. The gate shift clock (GSC) refers at least one clock signal for shifting the gate start pulse (GSP).

The source control signals include a source start pulse (SSP), a source sampling clock (SSC), and a source output enable signal (SOE). The source control signals may also include control signals (TMUXA and TMUXB). The source start pulse (SSP) controls a data sampling start time of the data driver 120. The source start pulse (SSP) is synchronized with the horizontal synchronizing signal Hsync and is applied to the data driver 120. The source sampling clock (SSC) controls a sampling operation of the data driver 120 with respect to a rising or falling edge. The source output enable signal (SOE) controls output timing of the data driver 120.

The signal controller 130 distinguishes the image data signals (IS) for respective frames based on the vertical synchronization signal Vsync and distinguishes the image data signals (IS) for respective scan lines based on the horizontal synchronizing signal Hsync to generate the image data (DATA).

The host 140 supplies the image data signals (IS) to the signal controller 130 through a predetermined interface. The host 140 also supplies the control signals Vsync, Hsync, DE, and MCLK to the signal controller 130.

The data driver 120 will now be described in detail with reference to FIG. 2 and FIG. 3.

Figure 2:
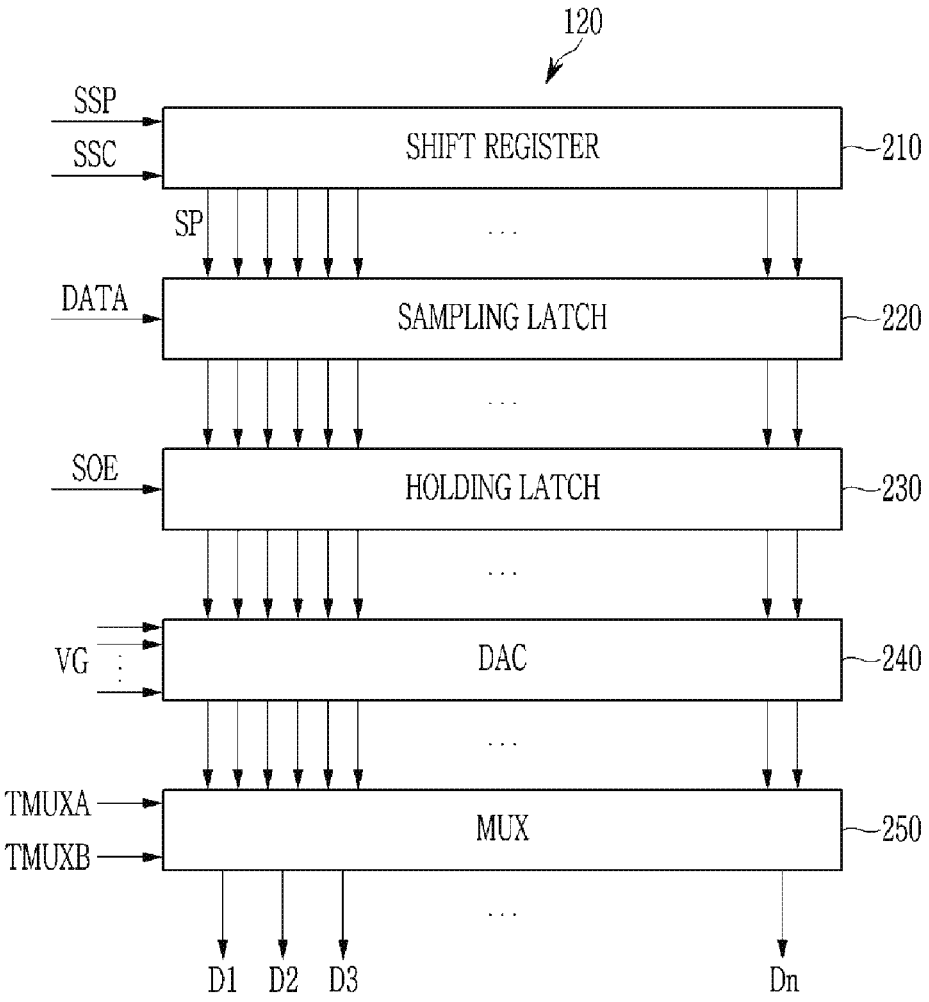
FIG. 2 shows a block diagram of a data driver included in the display device of FIG. 1 according to an exemplary embodiment of the inventive concept.
Figure 3:
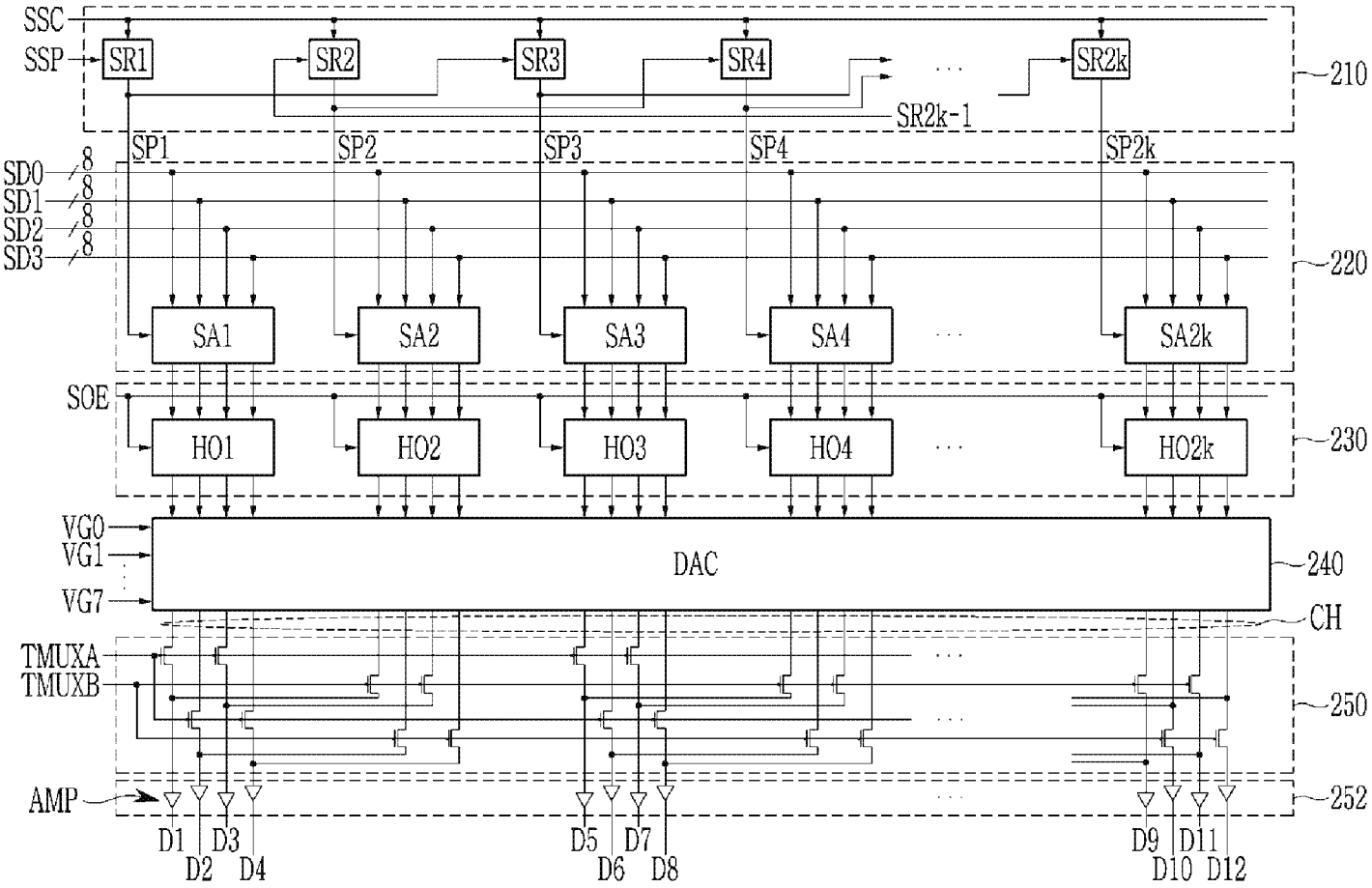
FIG. 3 shows the data driver of FIG. 2 in detail according to an exemplary embodiment of the inventive concept.

FIG. 2 shows a block diagram of a data driver included in the display device of FIG. 1 according to an exemplary embodiment of the inventive concept, and FIG. 3 shows the data driver of FIG. 2 in detail according to an exemplary embodiment of the inventive concept.

As shown in FIG. 2, the data driver 120 includes a shift register 210, sampling latches 220, holding latches 230, a digital-analog converter 240, and a multiplexer (MUX) 250.

The shift register 210, the sampling latches 220, and the holding latches 230 receive the image data (DATA) from the signal controller 130 corresponding to the source control signals (SSP, SSC, and SOE).

In detail, the shift register 210 receives the source start pulse (SSP) and the source sampling clock (SSC) from the signal controller 130. The shift register 210 having received the source sampling clock (SSC) shifts the source start pulse (SSP) for each period of the source sampling clock (SSC), and sequentially generates sampling pulses (SP). For this purpose, the shift register 210 may include a plurality of shift registers.

The sampling latches 220 sequentially stores the image data (DATA) corresponding to the sampling pulses (SP) sequentially provided by the shift register 210. For example, the sampling latches 220 may sequentially store the image data (DATA) corresponding to at least one channel in correspondence or in response to the sampling pulses (SP). For this purpose, the sampling latches 220 may include a plurality of sampling latches for storing the image data (DATA) corresponding to at least one channel.

The holding latches 230 receive the image data (DATA) from the sampling latches 220 and store the same when the source output enable signal (SOE) is input. In this case, the holding latches 230 may simultaneously receive the image data (DATA) stored in the sampling latches 220. When the source output enable signal (SOE) is input, the holding latches 230 supplies the stored image data (DATA) to the digital-analog converter 240. For this purpose, the holding latches 230 may include a plurality of holding latches for storing image data (DATA) corresponding to at least one channel.

The digital-analog converter (DAC) 240 generates a data signal by using the image data (DATA). For this purpose, the DAC 240 is provided on each channel. The DAC 240 selects at least one of gamma voltages (VG) corresponding to the gray of the supplied image data (DATA), and supplies the selected voltage to the multiplexer 250 as a data signal.

The multiplexer 250 may selectively transmit part of the data signals output by the DAC 240 to the data channels (D1 to Dn) in response to the control signals (TMUXA and TMUXB).

For example, when the control signal (TMUXA) has an enable level, the multiplexer 250 supplies the data signal transmitted by first holding latches to the data channels (D1 to Dn). When the control signal (TMUXB) has an enable level, the multiplexer 250 supplies the data signals transmitted by second holding latches to the data channels (D1 to Dn).

Referring to FIG. 3, the shift register 210 includes 2*k* (where k is a natural number) shift registers (SR1 to SR2*k*). The shift registers (SR1 to SR2*k*) shift the source start pulse (SSP) and generate sampling pulses (SP1, SP3, . . . , SP2*k*, SP2, SP4, . . . , SP2*k*−1) corresponding to the source sampling clock (SSC). Here, the shift register (SR) outputs the signal corresponding to the enable period of the source sampling clock (SSC) as sampling pulses (SP1 to SP2*k*).

In detail, first shift registers (SR1, SR3, . . . ) of the shift register 210 are dependently connected to one another. For example, the sampling pulse SP1 of the first shift register SR1 is input to the first shift register SR3, and the sampling pulse SP3 of the first shift register SR3 is input to a next first shift register. A last first shift register SR2*k*−1 is connected to a second shift register SR2. In other words, the sampling pulse (SP2*k*−1) of the last first shift register SR2*k*−1 is input to the second shift register SR2. Second shift registers (SR2, SR4, . . . , SP2*k*) of the shift register 210 are dependently connected to one another.

The first shift registers (SR1, SR3, . . . ) of the shift register 210 shift the source start pulse (SSP) corresponding to the source sampling clock (SSC), generate the sampling pulses (SP1, SP3, . . . , SP2*k*−1), and output the same. The second shift registers (SR2, SR4, . . . , SR2*k*) of the shift register 210 shift the source start pulse (SSP) corresponding to the source sampling clock (SSC), generate the sampling pulses (SP2, SP4, . . . , SP2*k*), and output the same.

When the last first shift register SR2*k*−1 outputs the sampling pulse (SP2*k*−1), the second shift register SR2 starts to output the sampling pulse SP2. Hence, for one horizontal period 1H, the sampling pulses (SP1, SP3, . . . , SP2*k*−1) of the first shift registers (SR1, SR3, . . . ) and the sampling pulses (SP2, SP4, . . . , SP2*k*) of the second shift registers (SR2, SR4, . . . , SR2*k*) are output.

For ease of description in FIG. 3, it will be assumed that the image data (DATA) have eight bits, and that the image data (DATA) corresponding to four channels are substantially simultaneously input by data input terminals (SD0 to SD3).

The data input terminals (SD0 to SD3) respectively receive image data (DATA) from the signal controller 130.

The sampling latches 220 include 2*k* sampling latches (SA1 to SA2*k*). The sampling latches (SA1 to SA2*k*) store the image data (DATA) corresponding to the four channels to enable edges of the sampling pulses (SP1 to SP2*k*).

In detail, the first sampling latches (SA1, SA3, . . . ) of the sampling latches 220 respectively receive the image data (DATA) corresponding to the four channels from the data input terminals (SD0 to SD3) when the sampling pulses (SP1, SP3, . . . , SP2*k*−1) switch to the enable level. The second sampling latches (SA2, SA4, . . . , SA2*k*) of the sampling latches 220 respectively receive the image data (DATA) corresponding to the four channels from the data input terminals (SD0 to SD3) when the sampling pulses (SP2, SP4, . . . , SP2*k*) switch to the enable level.

The holding latches 230 include 2*k* holding latches (HO1 to HO2*k*). The holding latches (HO1 to HO2*k*) substantially simultaneously receive the image data (DATA) stored in the sampling latches (SA1 to SA2*k*) when the source output enable signal (SOE) is input. Here, the source output enable signal (SOE) is input at least twice for one horizontal period 1H.

In detail, first holding latches (HO1, HO3, . . . ) of the holding latches 230 substantially simultaneously receive the image data (DATA) stored in the first sampling latches (SA1, SA3, . . . ) when the source output enable signal (SOE) is input. Second holding latches (HO2, HO4, . . . , HO2*k*) of the holding latches 230 substantially simultaneously receive the image data (DATA) stored in the second sampling latches (SA2, SA4, . . . , SA2*k*) when the source output enable signal (SOE) is input.

The digital-analog converter 240 converts the gray of the image data (DATA) into a data signal of an analog voltage by using at least one of a plurality of gamma voltages (VG0 to VG7).

The multiplexer 250 may rearrange output signals of the digital-analog converter 240 in response to the control signals (TMUXA and TMUXB). The multiplexer 250 includes transistors connected to channels (CH). The transistors are respectively turned on by the control signal (TMUXA) or the control signal (TMUXB) to connect a part of the channels (CH) and the data channels (D1 to Dn), or another part of the channels (CH) and the data channels (D1 to Dn).

In detail, the multiplexer 250 may output the analog signals corresponding to the image data (DATA) output by the first holding latches (HO1, HO3, . . . ) to the data channels (D1 to Dn) in response to the control signal (TMUXA). The multiplexer 250 may output the analog signals corresponding to the image data (DATA) output by the second holding latches (HO2, HO4, . . . , HO2*k*) to the data channels (D1 to Dn) in response to the control signal (TMUXB).

The data driver 120 further includes an output buffer 252 connected to the channels (CH), buffering the output signals of the multiplexer 250, and outputting the same to the data channels (D1 to Dn). The output buffer 252 may include a plurality of amplifiers (AMP).

According to exemplary embodiments of the inventive concept, the shift register 210, the sampling latches 220, the holding latches 230, the digital-analog converter 240, the multiplexer 250, and the output buffer 252 may be realized as a single chip, as independent chips, or a combination thereof.

The data channels (D1 to Dn) are connected to the switch circuit 102. The switch circuit 102 will now be described with reference to FIG. 4.

Figure 4:
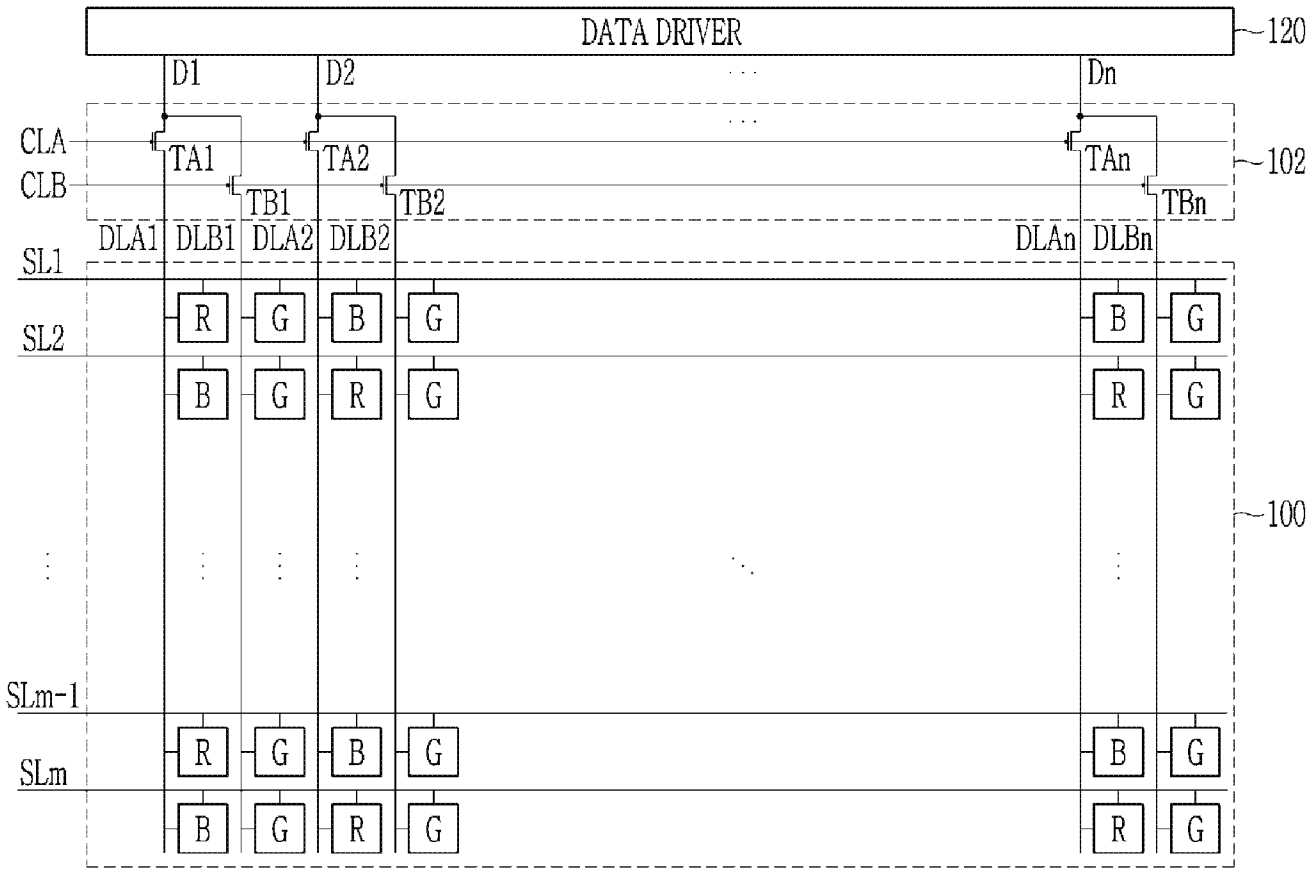
FIG. 4 shows a display panel, a switch circuit, and a data driver included in the display device of FIG. 1 according to an exemplary embodiment of the inventive concept.

FIG. 4 shows a display panel, a switch circuit, and a data driver included in the display device of FIG. 1 according to an exemplary embodiment of the inventive concept.

As shown, the display panel 100 may have a pentile structure. For example, the display panel 100 may include odd rows in which red subpixels (R), green subpixels (G), and blue subpixels (B) are disposed in an order of the red subpixel (R), the green subpixel (G), the blue subpixel (B), and the green subpixel (G), and even rows in which they are disposed in an order of the blue subpixel (B), the green subpixel (G), the red subpixel (R), and the green subpixel (G).

The above-described pixel (PXij) includes a red subpixel (R) and a green subpixel (G) or includes a blue subpixel (B) and a green subpixel (G).

Therefore, the red subpixels (R) and the blue subpixels (B) may be alternately connected to data lines (DLA1, DLA2, . . . , DLAn), and the green subpixels (G) may be connected to data lines (DLB1, DLB2, . . . , DLBn).

The switch circuit 102 receives a first selection signal (CLA) and a second selection signal (CLB) from the signal controller 130. In an exemplary embodiment of the inventive concept, the first selection signal (CLA) and the second selection signal (CLB) may be alternately activated for one horizontal period 1H. In other words, for one horizontal period 1H, a section in which the first selection signal (CLA) is activated may not overlap a section in which the second selection control signal (CLB) is activated.

For one horizontal period 1H, the switch circuit 102 may transmit the data signals transmitted by the data channels (D1 to Dn) to the data lines (DLA1, DLA2, . . . , DLAn) and the data lines (DLB1, DLB2, . . . , DLBn) based on the first selection signal (CLA) and the second selection signal (CLB).

The switch circuit 102 includes a plurality of first transistors (TA1, TA2, . . . , TAn) and a plurality of second transistors (TB1, TB2, . . . , TBn). The plurality of first transistors (TA1, TA2, . . . , TAn) each include a first end connected to a corresponding data channel from among the data channels (D1 to Dn), a second end connected to the data lines (DLA1, DLA2, . . . , DLAn), and a gate for receiving the first selection signal (CLA). The plurality of second transistors (TB1, TB2, . . . , TBn) each include a first end connected to a corresponding data channel from among the data channels (D1 to Dn), a second end connected to the data lines (DLB1, DLB2, . . . , DLBn), and a gate for receiving the second selection signal (CLB).

For example, when the first selection signal (CLA) is at the enable level, the plurality of first transistors (TA1, TA2, . . . , TAn) are turned on, and the switch circuit 102 transmits the data signals provided by the data channels (D1 to Dn) to the data lines (DLA1, DLA2, . . . , DLAn). When the second selection signal (CLB) is at the enable level, the plurality of second transistors (TB1, TB2, . . . , TBn) are turned on, and the switch circuit 102 transmits the data signals provided by the data channels (D1 to Dn) to the data lines (DLB1, DLB2, . . . , DLBn).

The switch circuit 102 may be provided in a predetermined region of the display panel 100, near the data driver 120. For example, the switch circuit 102 may be provided in a region provided near the data driver 120 on the same substrate as the display panel 100. In addition, the switch circuit 102 may be configured on an additional circuit board. The switch circuit 102 and the data driver 120 may be realized as a single semiconductor chip (IC).

Operations of the data driver 120 and the switch circuit 102 according to an exemplary embodiment of the inventive concept will now be described with reference to FIG. 5.

Figure 5:
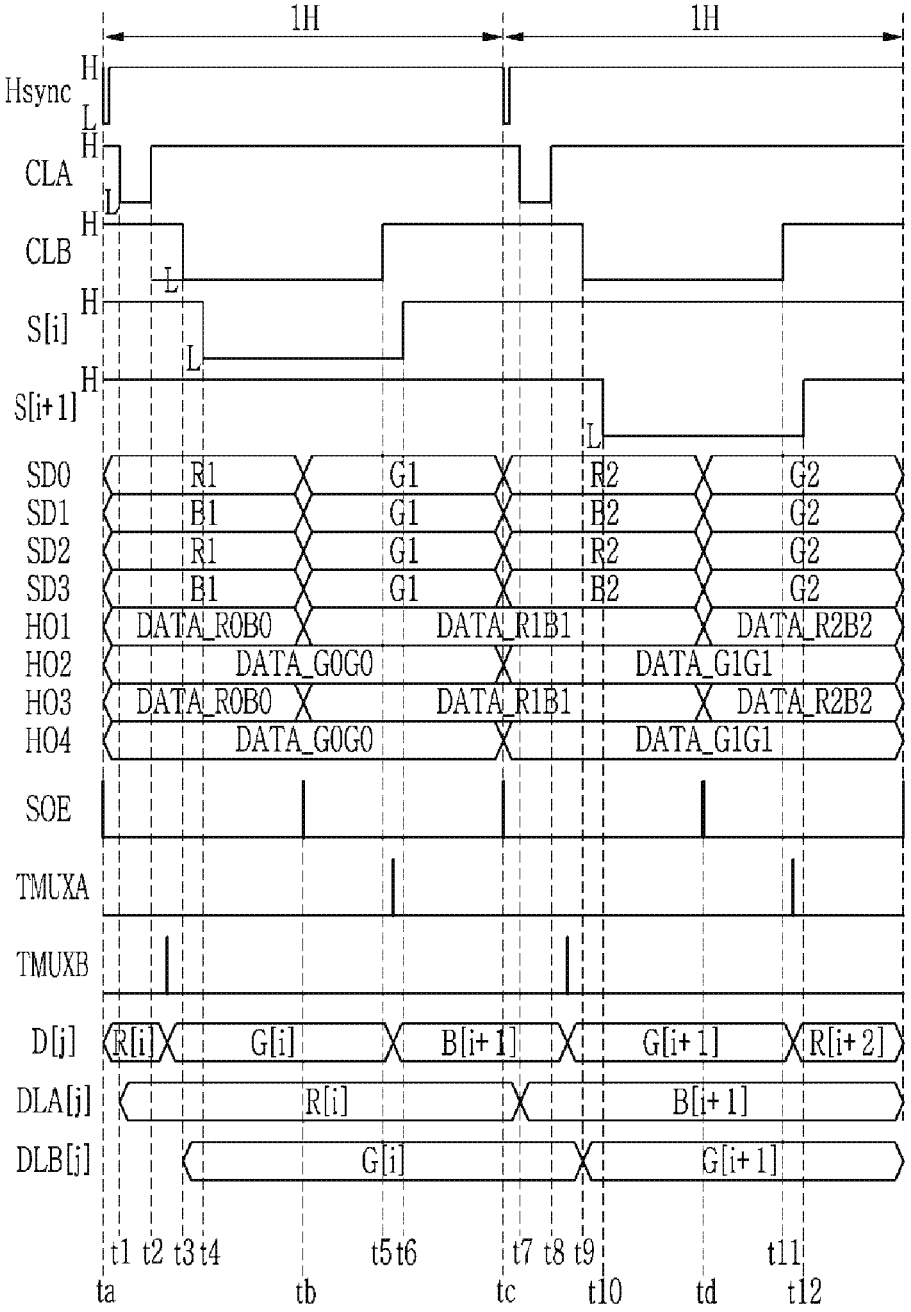
FIG. 5 shows a waveform diagram of an operating process of the data driver of FIG. 4 according to an exemplary embodiment of the inventive concept.

FIG. 5 shows a waveform diagram of an operating process of the data driver of FIG. 4 according to an exemplary embodiment of the inventive concept. For ease of description, FIG. 5 shows data signals (DLA[j], DLB[j]) applied to the j-th data lines (DLAj, DLBj) in a section in which the data signal corresponding to the i-th scan line (SLi) is applied and a section in which the data signal is applied corresponding to the (i+1)-th scan line (SLi+1). Hereinafter, it will be assumed that j is 1 and i is 2.

The horizontal synchronizing signal Hsync is repeated for respective scan lines and is applied on an enable level (L).

For a first horizontal period 1H, the first selection signal (CLA) has the enable level (L) for a section of t1 to t2 (a first section). In this instance, a data signal (R[i]) of the red subpixel (R) connected to the j-th data line (DLAj) and the i-th scan line (SLi) is applied to the data line (DLAj).

For a section between t2 to t3 (a third section), the control signal (TMUXB) is input, and the data signals corresponding to image data (DATA_GOGO) transmitted by the second holding latches (HO2, HO4, . . . , HO2*k*) are transmitted to the output buffer 252.

The second selection signal (CLB) has the enable level (L) for a section of t3 to t5 (a second section). In this instance, a data signal (G[i]) of the green subpixel (G) connected to the j-th data line (DLBj) and the i-th scan line (SLi) is applied to the data line (DLBj). The data signal (G[i]) corresponds to the image data (DATA_GOGO) output by the output buffer 252. The first section of t1 to t2 is shorter than the second section of t3 to t5.

For a section of t4 to t6 (a fifth section), the scan signal (S[i]) having the enable level (L) is applied to the i-th scan line (SLi). The data signal (R[i]) is applied to the red subpixel (R) connected to the j-th data line (DLAj) and the i-th scan line (SLi), and the data signal (G[i]) is applied to the green subpixel (G) connected to the j-th data line (DLBj) and the i-th scan line (SLi).

For a section of t5 to t7 (a fourth section), the control signal (TMUXA) is input, so the data signals corresponding to image data (DATA_R1B1) transmitted by the first holding latches (HO1, HO3, . . . ) are transmitted to the output buffer 252.

For the second horizontal period 1H, the first selection signal (CLA) has the enable level (L) for a section of t7 to t8. In this instance, a data signal (B[i+1]) of the blue subpixel (B) connected to the j-th data line (DLAj) and the (i+1)-th scan line (SLi) is applied to the data line (DLAj). The data signal (B[i+1]) corresponds to the image data (DATA_R1B1) output by the output buffer 252.

Between t8 and t9, the control signal (TMUXB) is input, and the data signals corresponding to image data (DATA_G1G1) transmitted by the second holding latches (HO2, HO4, . . . , HO2*k*) are transmitted to the output buffer 252.

The second selection signal (CLB) has the enable level (L) for a section of t9 to t11. In this instance, a data signal (G[i+1]) of the green subpixel (G) connected to the j-th data line (DLBj) and the (i+1)-th scan line (SLi+1) is applied to the data line (DLBj). The data signal (G[i+1]) corresponds to the image data (DATA_G1G1) output by the data channels (D1 to Dn).

For a section of t10 to t12, the scan signal (S[i+1]) having the enable level (L) is applied to the (i+1)-th scan line (SLi+1). The data signal (B[i+1]) is applied to the blue subpixel (B) connected to the j-th data line (DLAj) and the (i+1)-th scan line (SLi+1), and the data signal (G[i+1]) is applied to the green subpixel (G) connected to the j-th data line (DLBj) and the (i+1)-th scan line (SLi+1).

For the first horizontal period 1H, at the time of ta, the source start pulse (SSP) is applied to the shift register 210. Image data (R1, B1, R1, and B1) corresponding to the data lines (DLA1 to DLAj) are applied to the data input terminals (SD0 to SD3). The first sampling latches (SA1, SA3, . . . ) receive the image data (R1, B1, R1, and B1) corresponding to the data lines (DLA1 to DLAj) from the data input terminals (SD0 to SD3), and store the same when the sampling pulses (SP1, SP3, . . . , SP2*k*−1) switch to the enable level. According to an exemplary embodiment of the inventive concept, a time Tp for storing the image data (R1, B1, R1, and B1) for each group of four subpixels may be calculated as in Equation 1.

$$T_P = \frac{1080}{4} \times \frac{1}{115 \times 10^6} \approx 2.35\ \mu s \quad \text{(Equation 1)}$$

At a time of tb, the first holding latches (HO1, HO3, . . . ) receive the image data (R1, B1, R1, and B1) stored in the first sampling latches (SA1, SA3, . . . ) and store the same as the image data (DATA_R1B1) when the source output enable signal (SOE) is input.

When the control signal (TMUXA) is input, the analog data signal corresponding to the image data (DATA_R1B1) is transmitted to the data channels (D1 to Dn). The analog data signal corresponding to the image data (DATA_R1B1) transmitted to the data channels (D1 to Dn) is applied to the data lines (DLA1, DLA2, . . . , DLAn) while the first selection signal (CLA) has the enable level (L) for the second horizontal period 1H.

At the time of tb, image data (G1, G1, G1, and G1) corresponding to the data lines (DLB1 to DLBj) are applied to the data input terminals (SD0 to SD3). The second sampling latches (SA2, SA4, . . . , SA2K) respectively receive the image data (G1, G1, G1, and G1) corresponding to the data lines (DLB1 to DLBj) from the data input terminals (SD0 to SD3) when the sampling pulses (SP2, SP4, . . . , SP2*k*) switch to the enable level.

For the second horizontal period 1H, the second holding latches (HO2, HO4, . . . , HO2*k*) receive the image data (G1, G1, G1, and G1) stored in the second sampling latches (SA2, SA4, . . . , SA2*k*) and store the same as the image data (DATA_G1G1) when the next source output enable signal (SOE) is input. When the control signal (TMUXB) is input, the analog data signal corresponding to the image data (DATA_G1G1) is transmitted to the data channels (D1 to Dn). The analog data signal corresponding to the image data (DATA_G1G1) transmitted to the data channels (D1 to Dn) is applied to the data lines (DLB1, DLB2, . . . , DLBn) for a section in which the second selection signal (CLB) has the enable level (L) for the second horizontal period 1H.

In other words, data signals are respectively applied to the data lines (DLA1, DLA2, . . . , DLAn) and the data lines (DLB1, DLB2, . . . , DLBn) for one horizontal period 1H.

For one horizontal period 1H, the first selection signal (CLA) and the second selection signal (CLB) each have the enable level (L). The data signal (hereinafter, a first data signal) to be applied to the data lines (DLA1, DLA2, . . . , DLAn) is transmitted to the data channels (D1 to Dn) before the first selection signal (CLA) switches to the enable level. In a like manner, the data signal (hereinafter, a second data signal) to be applied to the data lines (DLB1, DLB2, . . . , DLBn) is transmitted to the data channels (D1 to Dn) before the second selection signal (CLB) switches to the enable level. In other words, for one horizontal period 1H, the first data signal and the second data signal may be sequentially applied to the data channels (D1 to Dn).

For this purpose, the control signal (TMUXA) and the control signal (TMUXB) are input once for one horizontal period 1H. In other words, when the control signal (TMUXA) is input, the multiplexer 250 transmits the first data signal provided by the channel (CH) to the data channels (D1 to Dn). When the first selection signal (CLA) switches to the enable level, the switch circuit 102 transmits the first data signal transmitted to the data channels (D1 to Dn) to the data lines (DLA1, DLA2, . . . , DLAn). When the first selection signal (CLA) changes to a disable level, the control signal (TMUXB) is input. The multiplexer 250 transmits the second data signal provided by the channel (CH) to the data channels (D1 to Dn). When the second selection signal (CLB) changes to the enable level, the switch circuit 102 transmits the second data signal provided to the data channels (D1 to Dn) to the data lines (DLB1, DLB2, . . . , DLBn).

Conventionally, the first data signal and the second data signal may be transmitted to the channel (CH) before input of the control signal (TMUXA) for one horizontal period 1H.

In detail, when the display panel with a resolution of 1080×2340 is driven by the frequency of 60 Hz, the one horizontal period 1H is calculated as expressed in Equation 2.

$$T_{1H} = \frac{1}{60 \times (2340 + 16)} \approx 6.78\ \mu s \quad \text{(Equation 2)}$$

In this instance, a time Tp for processing data to be input for one horizontal period 1H is calculated as in Equation 3. Equation 3 expresses a time for storing image data of pixels connected to one scan line in the sampling latches 220. It is assumed that image data (RGBG) on the basis of two pixels (RG or BG) for each clock signal of the source sampling clock (SSC) are stored in the sampling latches 220.

$$T_P = \frac{1080}{2} \times \frac{1}{115 \times 10^6} \approx 4.7\ \mu s \quad \text{(Equation 3)}$$

In other words, the time Tp for storing image data to be input corresponding to one scan line for one horizontal period 1H in the sampling latches 220 is 4.7 μs, and it is within the 6.78 μs that is one horizontal period 1H. Therefore, the display panel with the resolution of 1080×2340 may be driven with the frequency of 60 Hz according to a method for storing the image data (RGBG) based on respective groups of two pixels (RG or BG) corresponding to four data lines for each clock signal in the sampling latches 220.

In contrast, when the display panel with a resolution of 1080×2340 is driven with the frequency of 90 Hz, the one horizontal period 1H is calculated as expressed in Equation 4.

$$T_{1H} = \frac{1}{90 \times (2340 + 16)} \approx 4.71\ \mu s \quad \text{(Equation 4)}$$

In other words, the one horizontal period 1H is 4.71 μs, and the time for processing the data to be input for one horizontal period 1H is 4.7 μs. However, an additional time for charging the data signal in the data lines (DLA1, DLA2, . . . , DLAn, DLB1, DLB2, . . . , DLBn) may be required by an amplifier of the data driver 120 and a load of a fan-out wire of the display panel 100. In detail, one amplifier (AMP) drives two data lines (DLA and DLB), so a driving load of the amplifier (AMP) increases. When a transition amount of the data signals of the two subpixels is large and one amplifier (AMP) drives two data lines (DLA and DLB), the driving load of the amplifier (AMP) excessively increases, and at least one of the two data lines (DLA and DLB) may not be charged to a target level. Hence, an additional time between input of the control signal (TMUXA) for the first horizontal period 1H and input of the selection signal (CLA) for the second horizontal period 1H may be needed. In other words, the control signal (TMUXA) must be input for a section that is shorter than the 4.71 μs that is the one horizontal period 1H.

Therefore, the display panel with the resolution of 1080×2340 may not be driven with the frequency of 90 Hz according to the method for storing the image data (RGBG) based on respective groups of two pixels (RG or BG) for each clock signal in the sampling latch.

According to an exemplary embodiment of the inventive concept, the time Tp for storing the image data (R1, B1, R1, and B1) based on respective groups of four subpixels connected to the data lines (DLA1 to DLAj) for transmitting data signals at substantially the same timings (t1-t2, t7-t8) by the selection signal (CLA) in the sampling latches (SA1, SA3, . . . ) is calculated to be 2.35 μs as expressed in Equation 1. In other words, considering that the control signal (TMUXA) must be input for a period that is shorter than the 4.71 μs that is the one horizontal period 1H, the image data (R1, B1, R1, and B1) based on respective groups of four subpixels corresponding to the data lines (DLA1 to DLAj) may be stored in the sampling latches (SA1, SA3, . . . ) before the control signal (TMUXA) is input.

In a like manner, the time Tp for storing the image data (G1, G1, G1, and G1) based on the respective groups of four subpixels connected to the data lines (DLB1 to DLBj) for transmitting data signals at substantially the same timings (t3 to t5 and t9 to t11) in the sampling latches (SA2, SA4, . . . , SA2*k*) by the selection signal (CLB) is calculated to be 2.35 μs as expressed in Equation 1. In other words, the image data (G1, G1, G1, and G1) based on the respective groups of four subpixels corresponding to the data lines (DLB1 to DLBj) may be stored in the sampling latches (SA2, SA4, . . . , SA2*k*) in the present horizontal period 1H before the control signal (TMUXB) in the horizontal period 1H is input.

In other words, the display panel with the resolution of 1080×2340 may be driven with the frequency of 90 Hz according to the above-described method for sequentially storing the image data (RBRB or GGGG) based on the respective groups of four subpixels connected to the data line for transmitting the data signals at substantially the same timing in the sampling latches 220 by the selection signal (CLA or CLB) for each clock signal.

As described above, according to exemplary embodiments of the inventive concept, a high-resolution display device may be driven at a high speed without increasing the size of a data driver therein.

While the inventive concept has been shown and described with reference to exemplary embodiments thereof, it is to be understood by those of ordinary skill in the art that various modifications in form and details may be made thereto without departing from the spirit and scope of the inventive concept as set forth by appended claims.

What is claimed is:

1. A display device comprising:

a display unit including a plurality of first color subpixels, a plurality of second color subpixels, and a plurality of third color subpixels;

a scan driver configured to apply scan signals to a plurality of scan lines connected to the plurality of first color subpixels, the plurality of second color subpixels, and the plurality of third color subpixels;

a switch circuit configured to select a plurality of first data lines connected to the plurality of first color subpixels and the plurality of second color subpixels for a first section in each horizontal period, each of the plurality of first data lines coupled to at least one of the plurality of first color subpixels and at least one of the plurality of second color subpixels, and to select a plurality of second data lines connected to the plurality of third color subpixels for a second section after the first section in each horizontal period; and a data driver configured to apply data signals corresponding to the plurality of third color subpixels to the switch circuit for a third section between the first section and the second section in each horizontal period, and apply data signals corresponding to the plurality of first color subpixels and the plurality of second color subpixels to the switch circuit for a fourth section after the second section in each horizontal period.

2. The display device of claim 1, wherein the data driver includes:

a shift register configured to shift a source start pulse and sequentially generate a sampling pulse corresponding to source sampling clock signals;

sampling latches configured to sequentially store first data corresponding to the plurality of first color subpixels and the plurality of second color subpixels and second data corresponding to the plurality of third color subpixels, in response to the sampling pulse;

holding latches configured to substantially simultaneously receive the first data stored in the sampling latches and store the same corresponding to a first source output enable signal, and substantially simultaneously receive the second data stored in the sampling latches and store the same corresponding to a second source output enable signal; and a digital-analog converter configured to generate data signals corresponding to the plurality of first color subpixels and the plurality of second color subpixels by using the first data stored in the holding latches, and generate data signals corresponding to the plurality of third color subpixels by using the second data.

3. The display device of claim 2, wherein the sampling latches include:

first sampling latches configured to store the first data corresponding to the plurality of first color subpixels and the plurality of second color subpixels; and second sampling latches configured to store the second data corresponding to the plurality of third color subpixels, and wherein the shift register applies the sampling pulse to the first sampling latches and applies the sampling pulse to the second sampling latches.

4. The display device of claim 3, wherein the holding latches include:

first holding latches connected to the first sampling latches; and second holding latches connected to the second sampling latches, and wherein the first source output enable signal is applied to the first holding latches when the sampling pulse is applied to the first sampling latches, and the second source output enable signal is applied to the second holding latches when the sampling pulse is applied to the second sampling latches.

5. The display device of claim 2, wherein the data driver further includes:

a multiplexer configured to selectively output one of a data signal corresponding to the plurality of first color subpixels and the plurality of second color subpixels and a data signal corresponding to the plurality of third color subpixels in response to a control signal; and an output buffer configured to transmit the data signal output by the multiplexer to a data line.

6. The display device of claim 5, wherein the multiplexer outputs the data signal corresponding to the plurality of third color subpixels for a third section between the first section and the second section in each horizontal period, and outputs the data signal corresponding to the plurality of first color subpixels and the plurality of second color subpixels for a fourth section after the second section in each horizontal period in response to the control signal.

7. The display device of claim 2, wherein the source start pulse is synchronized with each horizontal period and is applied to the shift register.

8. The display device of claim 2, wherein the digital-analog converter converts the first data and the second data into data signals with analog voltages by using at least one of a plurality of input gamma voltages.

9. The display device of claim 1, wherein the switch circuit includes:

first transistors connecting the data driver to the plurality of first data lines corresponding to a first selection signal; and second transistors connecting the data driver to the plurality of second data lines corresponding to a second selection signal.

10. The display device of claim 9, wherein the first transistors and the second transistors are provided on a same substrate as the display unit.

11. The display device of claim 1, wherein the scan driver sequentially applies a scan signal having an enable level to the plurality of scan lines, the scan signal has the enable level for a fifth section after the first section in each horizontal period, and at least part of the fifth section and the second section overlap each other.

12. The display device of claim 11, wherein the first section is shorter than the second section.

13. The display device of claim 1, wherein the display unit includes the plurality of scan lines, the plurality of first data lines, and the plurality of second data lines, and the plurality of first data lines and the plurality of second data lines extend in a first direction and are alternately provided in a second direction traversing the first direction.

14. A data driving device configured to output data signals to a switch circuit configured to select a plurality of first data lines connected to a plurality of first color subpixels and a plurality of second color subpixels for a first section in each horizontal period, each of the plurality of first data lines coupled to at least one of the plurality of first color subpixels and at least one of the plurality of second color subpixels, and select a plurality of second data lines connected to a plurality of third color subpixels for a second section after the first section, comprising:

a shift register configured to shift a source start pulse and sequentially generate a sampling pulse corresponding to source sampling clock signals;

sampling latches configured to sequentially store first data corresponding to the plurality of first color subpixels and the plurality of second color subpixels and second data corresponding to the plurality of third color subpixels, in response to the sampling pulse;

holding latches configured to substantially simultaneously receive the first data stored in the sampling latches corresponding to a first source output enable signal and substantially simultaneously receiving the second data stored in the sampling latches corresponding to a second source output enable signal; and a digital-analog converter configured to generate a data signal corresponding to the plurality of first color subpixels and the plurality of second color subpixels by using the first data stored in the holding latches, and generating a data signal corresponding to the plurality of third color subpixels by using the second data.

15. The data driving device of claim 14, wherein the sampling latches include:

first sampling latches configured to store the first data corresponding to the plurality of first color subpixels and the plurality of second color subpixels; and second sampling latches configured to store the second data corresponding to the plurality of third color subpixels, and wherein the shift register applies the sampling pulse to the second sampling latches after applying the sampling pulse to the first sampling latches.

16. The data driving device of claim 15, wherein the holding latches include:

first holding latches connected to the first sampling latches; and second holding latches connected to the second sampling latches, and wherein the first source output enable signal is applied to the first holding latches after the sampling pulse is applied to the first sampling latches and the second source output enable signal is applied to the second holding latches after the sampling pulse is applied to the second sampling latches.

17. The data driving device of claim 14, further comprising:

a multiplexer configured to selectively output one of a data signal corresponding to the plurality of first color subpixels and the plurality of second color subpixels and a data signal corresponding to the plurality of third color subpixels in response to a control signal; and an output buffer configured to transmit the data signal output by the multiplexer to a data line.

18. The data driving device of claim 17, wherein the multiplexer outputs the data signal corresponding to the plurality of third color subpixels for a third section between the first section and the second section in each horizontal period, and outputs the data signal corresponding to the plurality of first color subpixels and the plurality of second color subpixels for a fourth section after the second section in each horizontal period in response to the control signal.

19. The data driving device of claim 14, wherein the source start pulse is synchronized with each horizontal period and is applied to the shift register.

20. The data driving device of claim 14, wherein the digital-analog converter converts the first data and the second data into data signals with analog voltages by using at least one of a plurality of input gamma voltages.

* * * * *